US009696676B2

(12) United States Patent
Morita et al.

(10) Patent No.: US 9,696,676 B2
(45) Date of Patent: Jul. 4, 2017

(54) IMAGE FORMING APPARATUS

(71) Applicant: Brother Kogyo Kabushiki Kaisha, Nagoya-shi, Aichi-ken (JP)

(72) Inventors: Tetsuya Morita, Nagoya (JP); Yoshihiro Takeda, Nagoya (JP); Makoto Mori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/049,939

(22) Filed: Feb. 22, 2016

(65) Prior Publication Data

US 2016/0246236 A1 Aug. 25, 2016

(30) Foreign Application Priority Data

Feb. 23, 2015 (JP) ..... 2015-032440

(51) Int. Cl.
*G03G 15/00* (2006.01)

(52) U.S. Cl.
CPC ..... *G03G 15/6502* (2013.01)

(58) Field of Classification Search
CPC ..... G03G 15/6502
USPC ..... 399/393
See application file for complete search history.

(56) References Cited

U.S. PATENT DOCUMENTS

| | | | | |
|---|---|---|---|---|
| 5,136,339 | A * | 8/1992 | Morita | G03G 15/6502 271/127 |
| 6,264,195 | B1 * | 7/2001 | Hoberock | B65H 1/266 271/145 |
| 7,472,904 | B2 * | 1/2009 | Park | B65H 3/0684 271/117 |
| 8,517,374 | B2 * | 8/2013 | Washino | B65H 1/266 271/145 |
| 2007/0217844 | A1 * | 9/2007 | Yasuhara | B65H 1/266 399/393 |
| 2013/0134660 | A1 * | 5/2013 | Idehara | B65H 31/26 271/207 |

FOREIGN PATENT DOCUMENTS

JP H10-7270 A 1/1998

* cited by examiner

*Primary Examiner* — Anthony Nguyen
(74) *Attorney, Agent, or Firm* — Banner & Witcoff, Ltd.

(57) ABSTRACT

An image forming apparatus includes a main body, a sheet supply tray, and a restriction member configured to restrict movement of the sheet supply tray to outside of the main body and including an arm configured to move between a restriction position and a withdrawal position, and a restriction release surface. One of the main body and the sheet supply tray includes the restriction member. The other one includes a first inclined surface and a contact surface. The restriction release surface is configured to, when the sheet supply tray moves from an inside position toward outside of the main body, contact the restriction member to cause the restriction member to move from the restriction position to the withdrawal position by that the sheet supply tray located at the outside position pivots around a downstream end of the sheet supply tray in the attachment direction.

18 Claims, 9 Drawing Sheets

IMAGE FORMING APPARATUS

CROSS REFERENCE TO RELATED APPLICATION

This application claims priority from Japanese Patent Application No. 2015-032440 filed on Feb. 23, 2015, which is incorporated herein by reference in its entirety.

FIELD

Aspects of the disclosure relate to an image forming apparatus including a sheet supply tray configured to be attached to and removed from a main body of the image forming apparatus.

BACKGROUND

A known image forming apparatus includes a sheet supply tray configured to be attached to and removed from a main body. In the image forming apparatus, when the sheet supply tray is located at an outside position, a stopper of the main body engages a protrusion of the sheet supply tray to restrict removal of the sheet supply tray from the main body. When the sheet supply tray is removed from the main body, a rear portion of the sheet supply tray is lifted such that the protrusion moves over and out of engagement with the stopper, and the sheet supply tray can be removed from the main body. When the sheet supply tray is attached to the main body, the rear portion of the sheet supply tray is lifted such that the protrusion moves over the stopper to be inserted into the stopper, and the sheet supply tray can be attached to the main body.

SUMMARY

However, in the above art, there is need to lift the sheet supply tray when the sheet supply tray is attached to or removed from the main body, which impairs handling of the sheet supply tray.

Illustrative aspects of the disclosure provide an image forming apparatus facilitating handling of a sheet supply tray when attached to or removed from a main body.

According to an aspect of the disclosure, an image forming apparatus includes a main body, a sheet supply tray configured to slide along a specified direction relative to the main body and move between an inside position where the sheet supply tray is attached to the main body and an outside position in which the sheet supply tray is pulled out from the inside position, and a restriction member configured to, when the sheet supply tray is in the outside position, which is upstream of the inside position in an attachment direction in which the sheet supply tray is attached to the main body, restrict movement of the sheet supply tray to outside of the main body, the restriction member including an arm configured to move between a restriction position where the arm restricts movement of the sheet supply tray and a withdrawal position where the arm is withdrawn from the restriction position, the arm being configured to pivot about an axis relative to the main body and extending from the axis. One of the main body and the sheet supply tray includes the restriction member. The other one of the main body and the sheet supply tray includes a first inclined surface configured to restrict the movement of the sheet supply tray to the outside of the main body by contact with the restriction member located at the restriction position, and a contact surface configured to, when the sheet supply tray moves toward the inside position, cause the restriction member to move to the withdrawal position by contact with the restriction member before the sheet supply tray reaches the outside position. The image forming apparatus further includes a restriction release surface configured to, when the sheet supply tray moves from the inside position toward outside of the main body, contact the restriction member to cause the restriction member to move from the restriction position to the withdrawal position by that the sheet supply tray located at the outside position pivots around a downstream end of the sheet supply tray in the attachment direction.

With this structure, when the sheet supply tray is attached to the main body, the contact surface causes the restriction member to move to the withdrawal position before the sheet supply tray reaches the outside position. Thus, during attachment of the sheet supply tray, an operation in which the restriction member moves over the first inclined surface becomes unnecessary. In other words, the sheet supply tray can be attached to the main body without restriction by the restriction member, which improves the ease of use in attachment and removal of the sheet supply tray relative to the main body.

DETAILED DESCRIPTION

An illustrative embodiment will be described in detail with reference to the accompanying drawings. In the following description, a general structure of a laser printer as an example of an image forming apparatus will be described and then features of the disclosure will be described in detail.

In the following description, orientations or sides of the laser printer 1 will be identified based on the laser printer disposed in an orientation in which it is intended to be used. In other words, in FIG. 1, the right side is referred to as the front or front side, the left side is referred to as the rear or the rear side, the up side is referred to as the top or upper side, and the down side is referred to as the bottom or lower side. The up-down direction may be referred to as a vertical direction.

Figure 1:
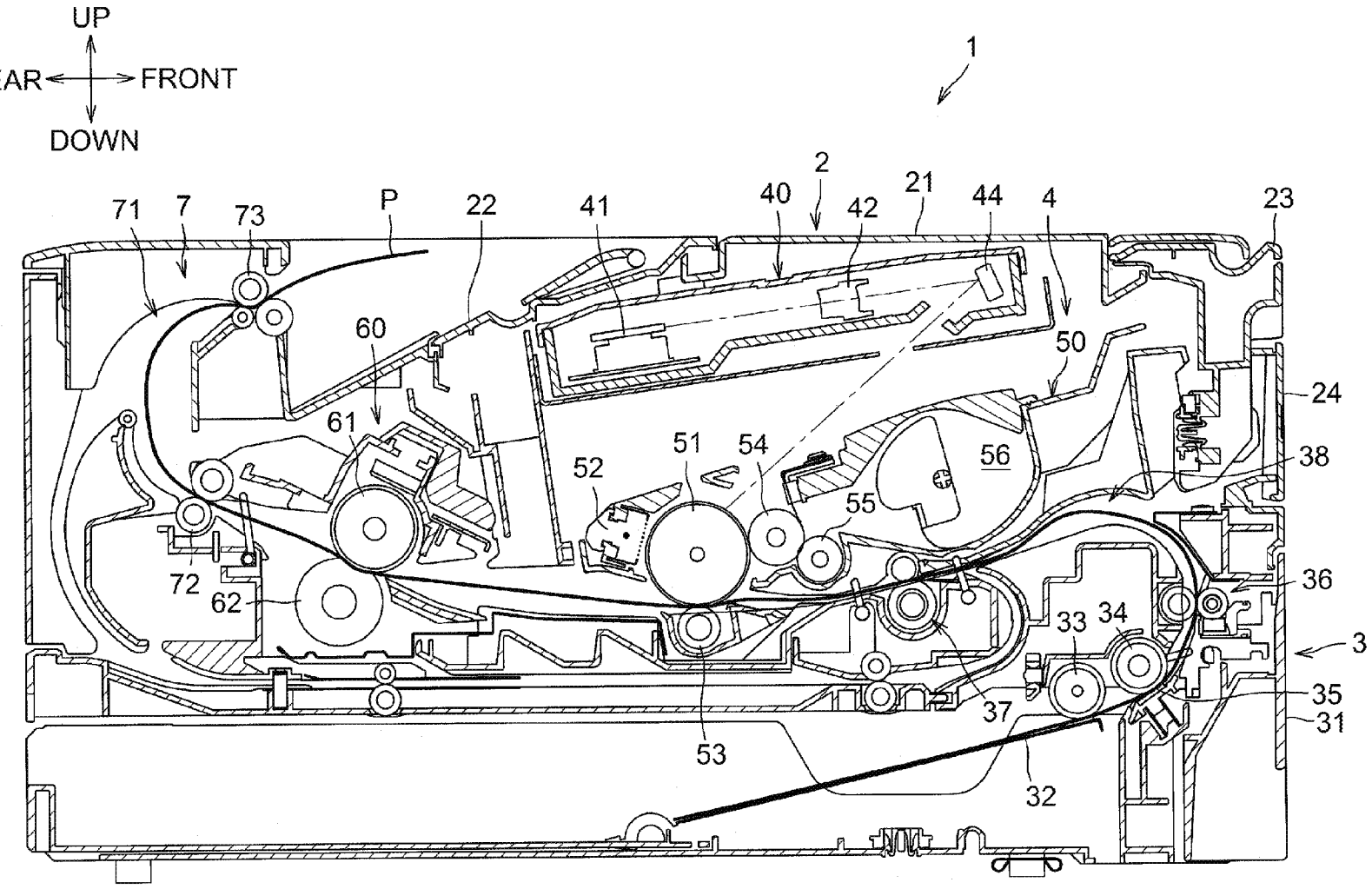
FIG. 1 illustrates a general structure of a laser printer according to an embodiment of the disclosure.

As shown in FIG. 1, the laser printer 1 is configured to form an image on a sheet P, and mainly includes a casing 2 as an example of a main body, a feeder portion 3, an image forming portion 4, and a sheet ejection portion 7.

The casing 2 includes a front cover 23 to be open when a process cartridge 50 is attached to or removed from the casing 2. The front cover 23 is provided with a manual feed tray 24 for manually feeding a sheet P. The manual feed tray 24 is pivotable.

The feeder portion 3 is configured to supply a sheet P to the image forming unit 4 and disposed in a lower portion of the casing 2. The feeder portion 3 includes a sheet supply tray 31 and a sheet pressing plate 32, a pickup roller 33, a separation roller 34, a separation pad 35, a dust removing roller 36, and a registration roller pair 37, and defines a sheet supply path 38.

The sheet supply path 38 is a path for conveying a sheet P fed from the sheet supply tray 31 to the image forming unit 4, more specifically to between a photosensitive drum 51 and a transfer roller 53. The sheet supply path 38 extends diagonally upward from a location proximate to the pickup roller 33, is curved rearward, and then extends toward between the photosensitive drum 51 and the transfer roller 53.

A stack of sheets P received on the sheet supply tray 31 is moved to the pickup roller 33 by the sheet pressing plate 32, and fed to the sheet supply path 38 by the pickup roller 33. The fed sheets P are singly separated from the stack of sheets P by the separation roller 34 and the separation pad 35, and conveyed singly by the dust removing roller 36. A skew of each of the sheets P is corrected by the registration roller pair 37 and each of the sheets P is conveyed toward the image forming unit 4.

The image forming unit 4 is configured to form an image on a supplied sheet P and is disposed above the sheet supply tray 31. The image forming unit 4 mainly includes an exposure unit 40, the process cartridge 50, and a fixing unit 60.

The exposure unit 40 is disposed in an upper portion of the casing 2, and includes a laser emitting portion, a polygon mirror 41, a lens 42, and a reflecting mirror 44. In the exposure unit 40, laser light (see the dash-dot line in FIG. 1) emitted from the laser light emitting portion based on image data passes through or reflects the polygon mirror 41, the lens 42, and the reflecting mirror 44 in this order and scans at high speed across the surface of the photosensitive drum 51.

The process cartridge 50 is located below the exposure unit 40, and includes the photosensitive drum 51, a charger 52, the transfer roller 53, a developing roller 54, a supply roller 55, and a toner chamber 56 storing toner therein.

The fixing unit 60 is disposed at the rear of the process cartridge 50 and includes a heat roller 61 and a pressure roller 62 disposed facing the heat roller 61 and pressing the heat roller 61.

In the image forming unit 4, the surface of the photosensitive drum 51 is uniformly charged by the charger 52, and then exposed with the laser beam from the exposure unit 40 by high speed scanning. Thus, an electrostatic latent image based on image data is formed on the surface of the photosensitive drum 51. Toner in the toner chamber 56 is supplied via the supply roller 55 to the developing roller 54 and carried on the developing roller 54.

The toner carried on the developing roller 54 is supplied to the electrostatic latent image formed on the photosensitive drum 51, and a toner image is formed on the surface of the photosensitive drum 51. Then, when a sheet P passes between the photosensitive drum 51 and the transfer roller 53, the toner image carried on the surface of the photosensitive drum 51 is transferred onto the sheet P. Then, when the sheet P passes between the heat roller 61 and the pressure roller 62, the toner image on the sheet P is thermally fixed.

The ejection portion 7 is configured to convey the sheet P having the toner image thermally fixed thereon to outside of the casing 2, defines an ejection path 71 and mainly includes a conveying roller 72 and an ejection roller 73.

The ejection path 71 is a curved path for guiding the sheet P conveyed from the fixing unit 60 to the ejection tray 22.

In the ejection portion 7, a sheet P having an image formed thereon ejected from the image forming unit 4 is conveyed to the ejection roller 73 while being curved upward from the rear to the front (as indicated by a solid line). The sheet P is ejected to the ejection tray 22 disposed in the upper portion of the casing 2.

The sheet supply tray 31 will be described.

The sheet supply tray 31 is slidable in the front-rear direction and is detachably attached to a lower portion of the casing 2. In the following description, a direction directed from the front to the rear in which the sheet supply tray 31 is attached to the casing 2 is referred to as an attachment direction.

Figure 4A:
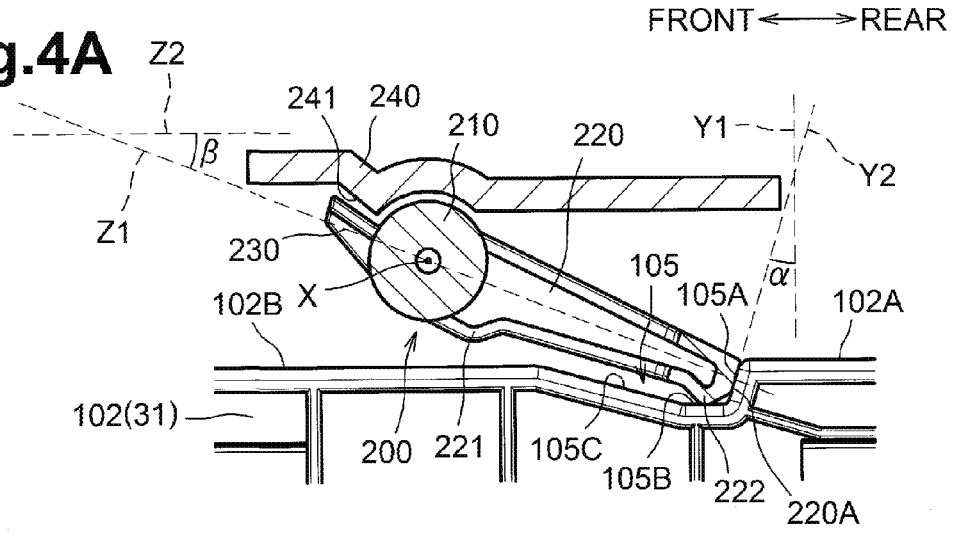
FIG. 4A illustrates a restriction member located at a restriction position.
Figure 5A:
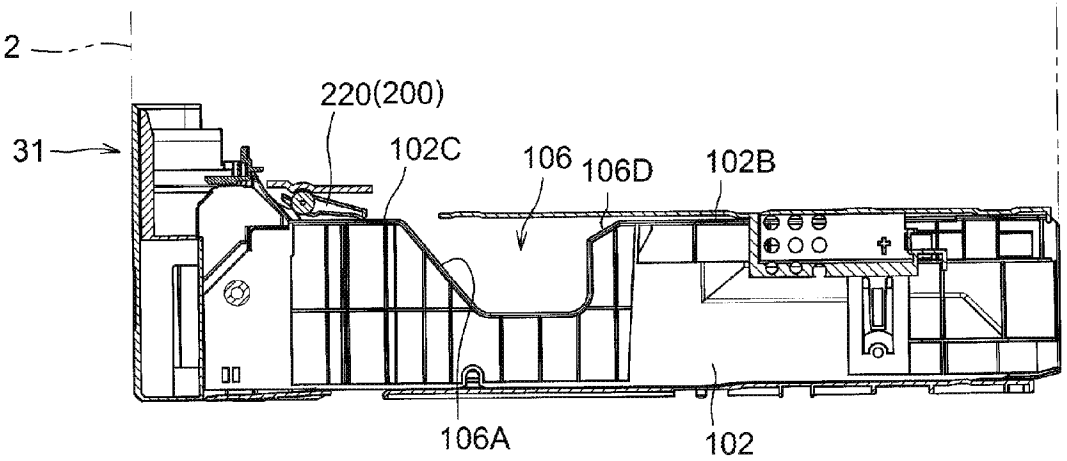
FIG. 5A illustrates the sheet supply tray located in an inside position.
Figure 6A:
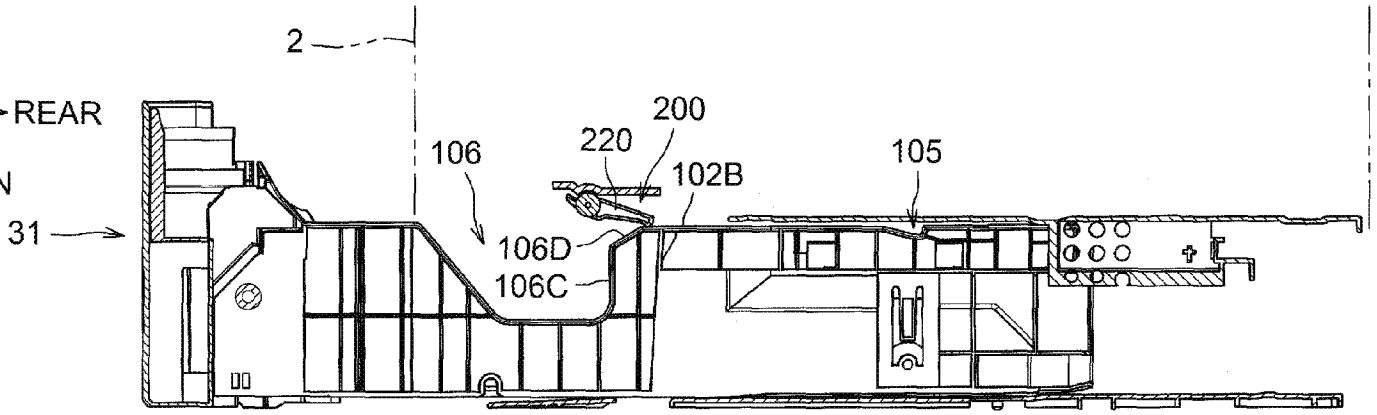
FIG. 6A illustrates the sheet supply tray further pulled out from the inside position.
Figure 6B:
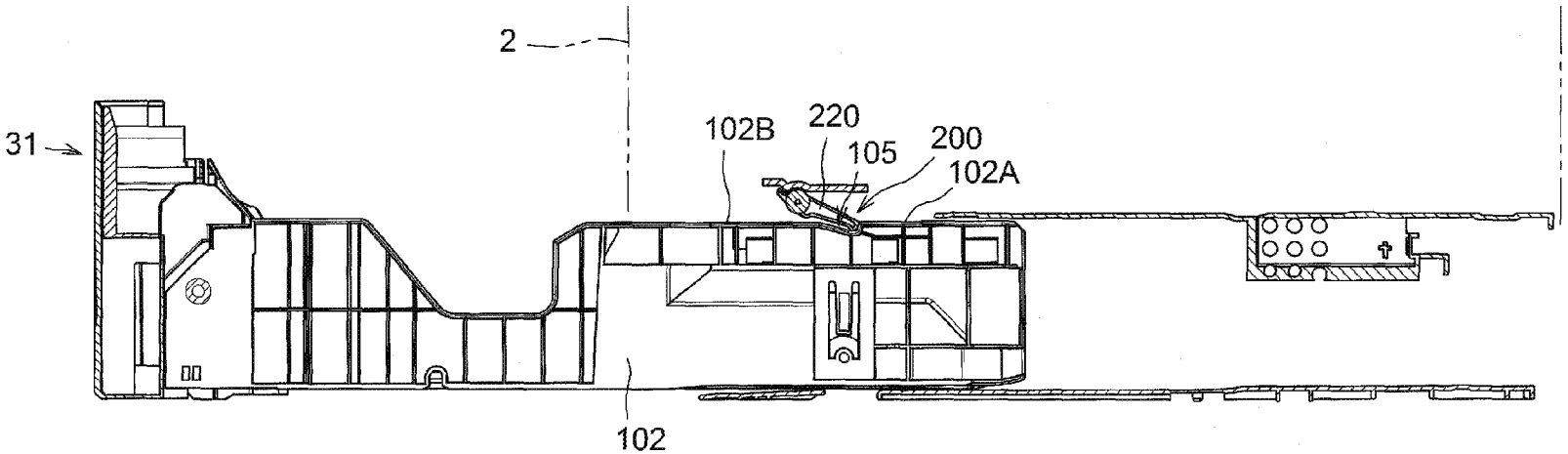
FIG. 6B illustrates the sheet supply tray located in an outside position.

When the sheet supply tray 31 is pulled out from an inside position (as illustrated in FIGS. 1 and 5A) where the sheet supply tray 31 is attached to the casing 2, a restriction member 200 (FIG. 4A) restricts frontward movement of the sheet supply tray 31 at an outside position (as illustrated in FIG. 6B), which is upstream of the inside position in the attachment direction or in front of the inside position.

Figures 2A, 2B:
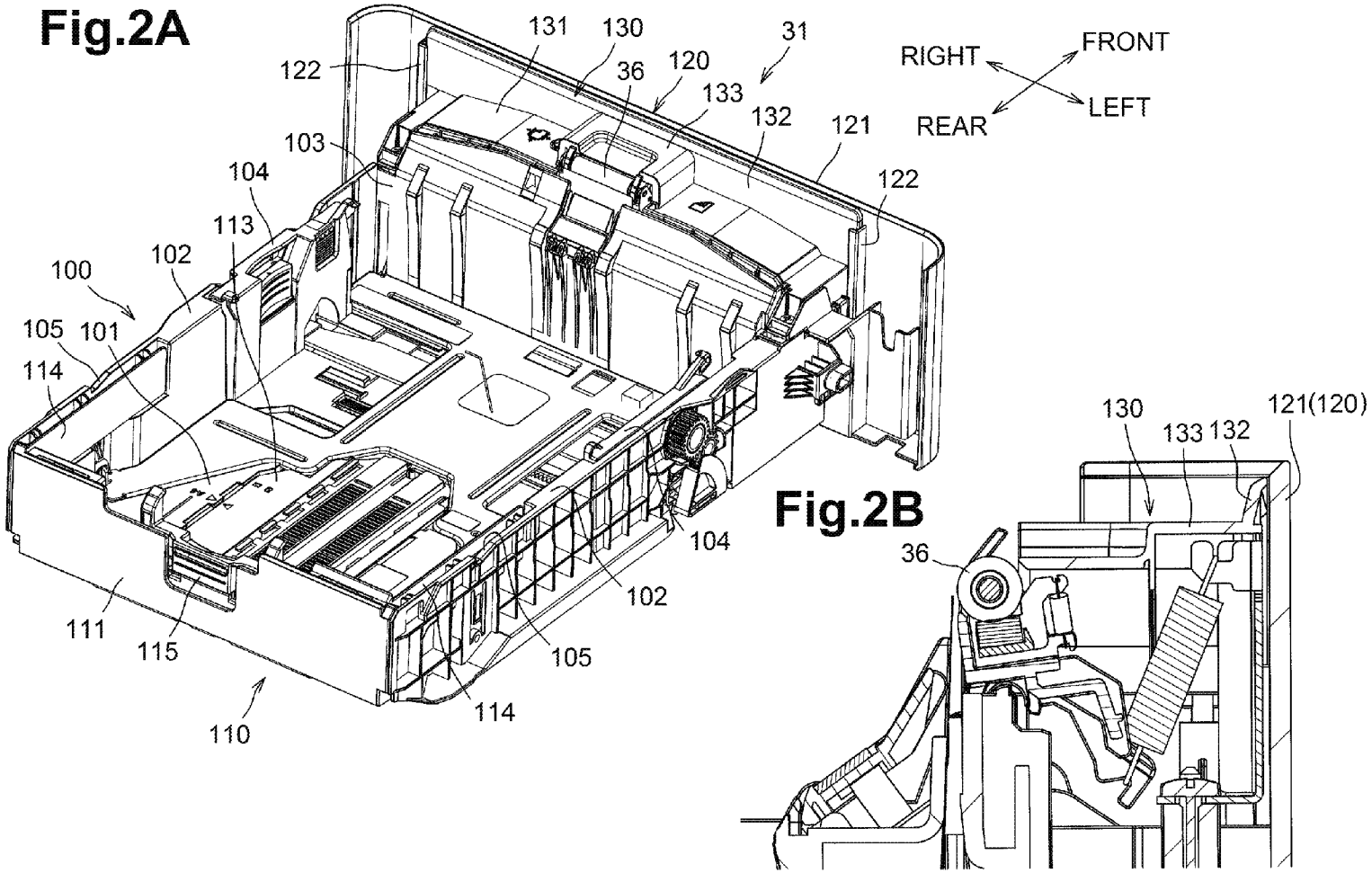
FIG. 2A is a perspective view illustrating a sheet supply tray viewed from the rear.
FIG. 2B is an enlarged cross-sectional view taken through the center of the sheet supply tray in a left-right direction, illustrating a dust collecting portion.

As illustrated in FIG. 2A, the sheet supply tray 31 includes a tray main body 100, a tray extension portion 110, a tray cover portion 120, and a dust storing portion 130. The tray main body 100 includes a bottom wall 101, left and right sidewalls 102 extending upward from left and right end of the bottom wall 101 and facing each other, and a front sidewall 103 connecting front portions of the left and right sidewalls 102.

The bottom wall 101 supports a pair of side guides 104 such that the side guides 104 are slidable in the left-right direction to adjust left and right end positions of a sheet P supported in the sheet supply tray 31.

Figure 3A:
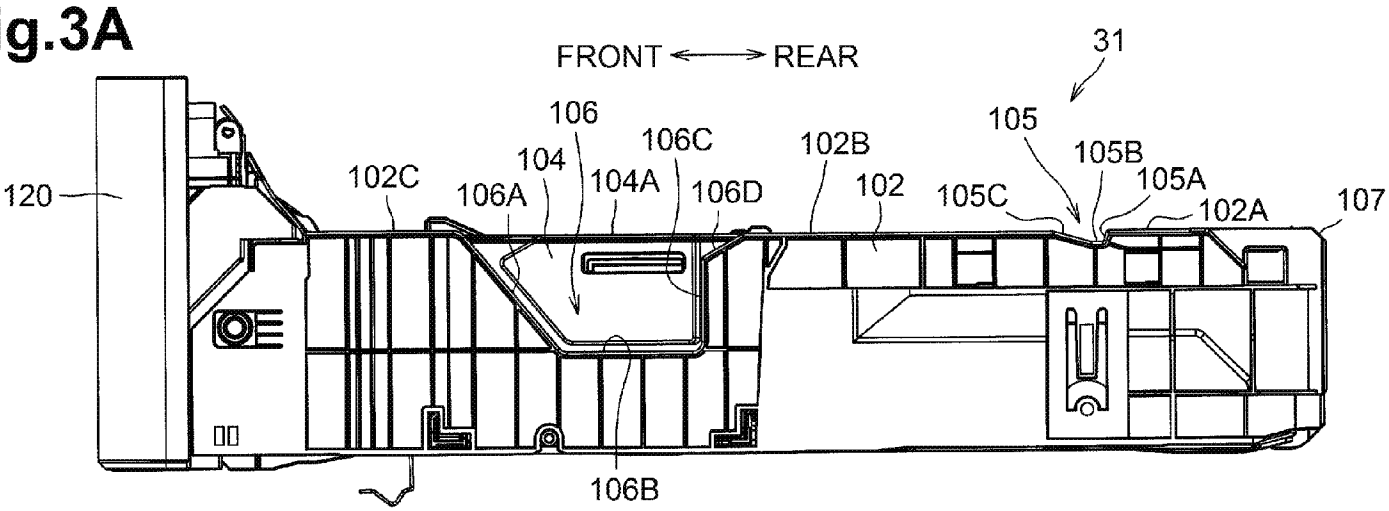
FIG. 3A is a right side view of the sheet supply tray.
Figure 3B:
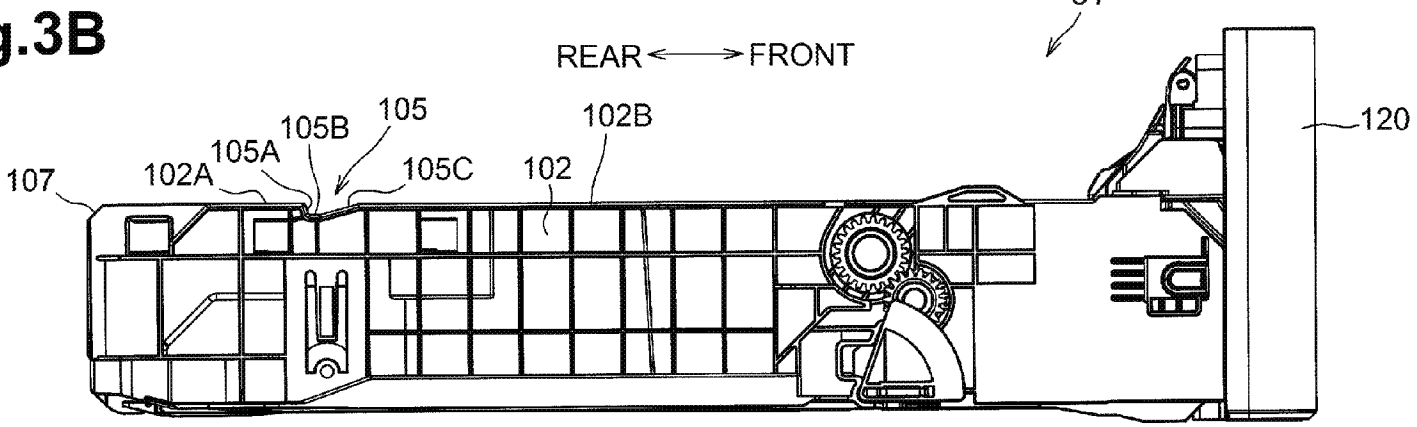
FIG. 3B is a left side view of the sheet supply tray.

As illustrated in FIGS. 3A and 3B, the left and right sidewalls 102 extend in the front-rear direction and each have a recessed portion 105 recessed downward from an upper end of a corresponding one of the left and right sidewalls 102. The recessed portion 105 is identical in shape and formed at substantially the same position in the front-rear direction.

The recessed portion 105 is defined by a first inclined surface 105A (refer also to FIG. 4A), the bottom surface 105B, and a second inclined surface 105C. Each of the sidewalls 102 has a first upper end surface 102A, as an example of a contact surface, formed at the rear of the recessed portion 105, and a second upper end surface 102B, as an example of a restriction release surface, formed at the front of the recessed portion 105. The first inclined surface 105A is inclined downward to the front, relative to the first upper end surface 102A. The bottom surface 105B extends frontward from the lower end of the first inclined surface 105A. The second inclined surface 105C is inclined upward from a front end of the bottom surface 105B to an upstream side in the attachment direction and connected to the second upper end surface 102B.

As illustrated in FIG. 3A, the right sidewall 102 has a second recessed portion 106 disposed in front of the recessed portion 105 (or the first inclined surface 105A) and recessed downward.

The second recessed portion 106 is located in a position facing the side guides 104 and defined by a front side surface 106A, a bottom surface 106B, a rear side surface 106C, and a third inclined surface 106D. The front side surface 106A is inclined downward to the rear, relative to a third upper end surface 102C located in front of the second recessed portion 106. The bottom surface 106B extends rearward from a lower end of the front side wall 106A. The rear side surface 106C extends upward from a rear end of the bottom surface 106B. The third inclined surface 106D is inclined upward from an upper end of the rear side surface 106C to a downstream side in the attachment direction, that is, to the rear, and connected to the second upper end surface 102B.

When the side guides 104 are located at the most outside positions, a portion of the right side guide 104 is located in the second recessed portion 106, and an upper end surface 104A of the right side guide 104 is substantially flush with the second upper end surface 102B and the third upper end surface 102C of the right sidewall 102. The first upper end surface 102A is also substantially flush with the second upper end surface 102B and the third upper end surface 102C. In other words, the first upper end surface 102A, the second upper end surface 102B, the third upper end surface 102C, and the upper end surface 104A of the side guide 104 extend substantially horizontally, and are aligned in a line in the attachment direction.

As illustrated in FIG. 3B, the second recessed portion 106 is not provided in the left sidewall 102. When the side guides 104 are at the most outside positions, the left side guide 104 is located inside of the left sidewall 102.

As illustrated in FIGS. 3A and 3B, each of the sidewalls 102 has a forth inclined surface 107 at a rear end. The fourth inclined surface 107 is inclined downward from a rear end of the first upper end surface 102A to the rear.

As illustrated in FIG. 2A, the tray extension portion 10 is disposed in a downstream portion of the tray main body 100 in the attachment direction, and includes a rear side wall 111 constituting a part of a rear surface of the casing 2, a first extension portion 113 extending to the front from a lower end of the rear side wall 111, and second extension portions 114 extending to the front from left and right ends of the rear side wall 111.

The first extension portion 113 is supported by the bottom wall 101 of the tray main body 100 such that it is slidable in the front-rear direction. The second extension portions 114 are supported by the sidewalls 102 of the tray main body 100 such that they are slidable in the front-rear direction.

The first extension portion 113 supports a rear guide 115 such that the rear guide 115 is slidable in the front-rear direction to adjust a rear end position of a sheet P.

The tray cover portion 120 includes a front wall 121, which is disposed connecting the sidewalls 102 upstream of (or in front of) the front sidewall 103 in the attachment direction and constitutes a part of the front surface of the casing 2.

As illustrated in FIGS. 2A and 2B, the dust storing portion 130 is disposed between the front wall 121 of the tray cover portion 120 and the front sidewall 103, or downstream of (or behind) the front wall 121 in the attachment direction. The dust storing portion 130 is configured to store sheet dust collected by the dust removing roller 36. The dust storing portion 130 includes a first wall 132 extending in the up, down, left and right directions, and a second wall 131 extending from a rear surface of the first wall 132 to the rear. A dust collecting portion 133 is disposed in a central portion of the second wall 131 in the left-right direction to collect dust from the dust removing roller 36.

The first wall 132 extends up to a location proximate to the upper end of the front wall 121 of the tray cover portion 120. Left and right ends of the first wall 132 are supported by left and right support portions 122, respectively, which are formed on the rear surface of the front wall 121 and have a hook-like shape. As the first wall 132 is disposed along the front surface 121, the front surface of the casing 2 increases in thickness, which improves the stiffness and ease of operation of the tray cover 120 gripped by the user.

The restriction member 200 will be described.

As illustrated in FIGS. 4A and 5A, the restriction member 200 is disposed in a front portion of the casing 2 and facing a corresponding one of the left and right sidewalls 102. The restriction member 200 is configured to, when the sheet supply tray 31 slid from the inside position is located at the outside position, engage in the recessed portion 105 and restrict the sheet supply tray 31 from moving outside of the casing 2.

The restriction member 200 includes a pivot portion 210 having an axis X, an arm 220 extending downward from the pivot portion 210 to a downstream side in the attachment direction, and a protruding portion 230 protruding diagonally upward from the pivot portion 210 to the front.

The arm 220 is configured to pivot about the axis X relative to the casing 2, and includes a protruding portion 221 and a second protruding portion 222, which protrude downward.

The protruding portion 221 is disposed closer to the axis X than an end of the arm 220, that is, disposed in a base portion of the arm 220. When the sheet supply tray 31 is in the inside position, the protruding portion 221 is spaced upward from the upper end surfaces 102A, 102B, and 102C. The second protruding portion 222 is disposed in an end portion of the arm 220 and has a downward end which is tapered.

The second protruding portion 222 is configured to contact the upper end surfaces 102A, 102B, and 102C of each of the sidewalls 102. In relative terms, the second protruding portion 222 contacts the upper end surfaces 102A, 102B, and 102C, whereby the end portion of the arm 220 slides on the upper end surfaces 102A, 102B, and 102C of each of the sidewalls 102.

The arm 220 described above is configured such that, when the sheet supply tray 31 moves from the inside position to the outside position, the end of the arm 220 enters the recessed portion 105. More specifically, the second protruding portion 222 of the arm 220 contacts the third upper end surface 102C and the second upper end surface 102B, moves along the second inclined surface 105C of the recessed portion 105, and then contacts the bottom surface 105B. An end surface 220A of the arm 220, which faces diagonally downward, contacts the first inclined surface 105A. With this contact, movement of the sheet supply tray 31 outside of the casing 2 is restricted.

At this time, a first angle a of the first inclined surface 105A with respect to a first plane Y1 orthogonal to the attachment direction is smaller than a second angle β formed by the attachment direction and a line Z1 connecting the axis X and a contact point where the end surface 220A of the arm 220 contacts the first inclined surface 105A. In other words, the first angle a of a plane Y2 coplanar with the first inclined surface 105A with respect to the first surface Y1 is smaller than the second angle β which the line Z1 forms with a line Z2 parallel to the attachment direction. When the end surface 220A and the first inclined surface 105A have surface contact, the contact point is referred to as the center of gravity of a contact surface between the end surface 220A and the first inclined surface 105A.

Figure 4B:
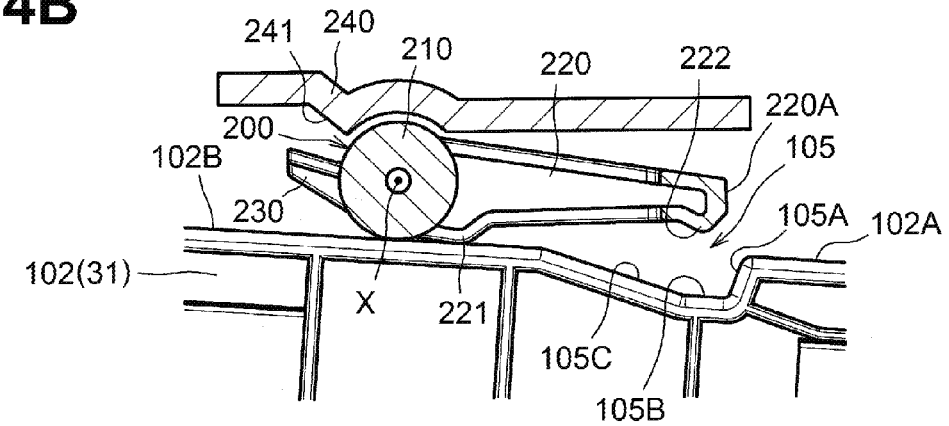
FIG. 4B illustrates the restriction member located at a withdrawn position.

When the sheet supply tray 31 is located at the outside position, the protruding portion 221 is spaced from the second upper end surface 102B. At this time, when the sheet supply tray 31 is tilted upward about a rear end portion of the sheet supply tray 31 or an end portion thereof in the attachment direction, the second upper end surface 102B contacts the protruding portion 221 of the arm 220, and the end portion of the arm 220 moves upward, as illustrated in FIG. 4B. As the arm 220 moves upward in this manner, the end surface 220A is withdrawn from the first inclined surface 105A. In other words, the restriction member 200 moves from the restriction position to a withdrawal position. The withdrawal position is a position at which the end portion of the arm 220 is spaced upward from the recessed portion 105. FIGS. 4B and 7B illustrate that the restriction member 200 is located at the withdrawal although they illustrate the position of the restriction member 200 slightly differently.

After the restriction member 200 is moved to the withdrawal position, when the sheet supply tray 31 is pulled out with the protruding portion 221 being supported on the second upper end surface 102B, the recessed portion 105 moves to the front further than the second protruding portion 222. After that, even when tilting of the sheet supply tray 31 is returned, the second protruding portion 222 does not enter the recessed portion 105and contacts a rear portion of the first inclined surface 102A.

The restricted movement of the sheet supply tray 31 located at the outside position can be released by allowing the arm 220 to move between the restriction position and the withdrawal position.

Figure 4C:
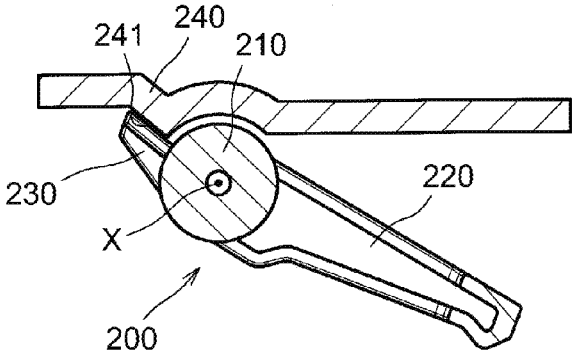
FIG. 4C illustrates a protruding portion of the restriction member engaging an engaging portion.

The housing 2 includes an engaging portion 240, as an example of a restricting portion. The engaging portion 240 is configured to engage the protruding portion 230 and is disposed above the restriction member 200. The engaging portion 240 has an engaging surface 241, which is disposed downstream of the protruding portion 230 in a clockwise direction and facing the protruding portion 230. As illustrated in FIG. 4C, the restriction member 200 is configured such that, when the engaging surface 241 engages the protruding portion 230, the end portion of the arm 220 is restricted from moving downward.

Figure 5B:
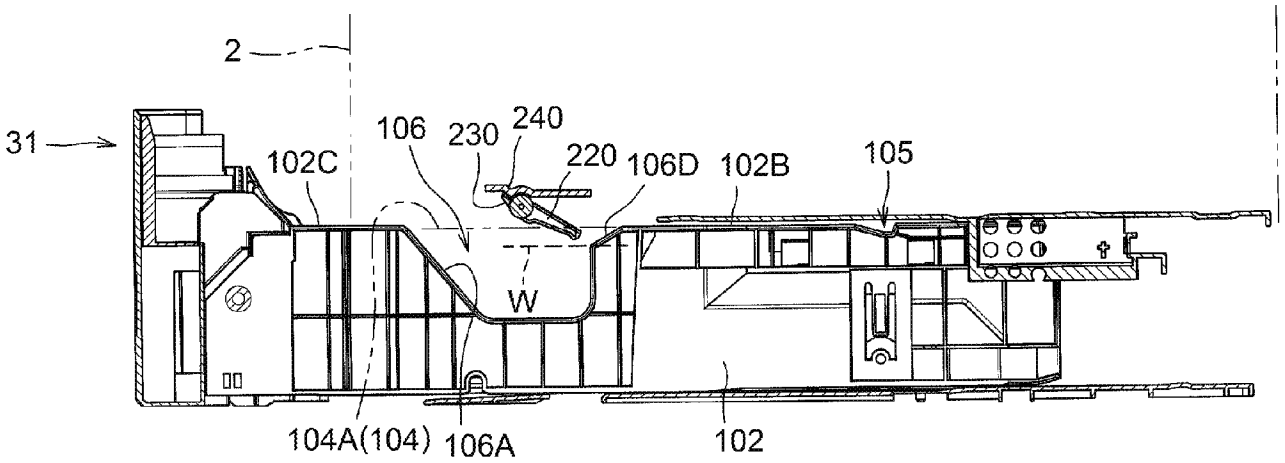
FIG. 5B illustrates the sheet supply tray pulled out from the inside position.

As illustrated in FIG. 5B, when the sheet supply tray 31 is moved with a part of the side guide 104 being out of the second recessed portion 106, that is, with the upper end surface 104A of the side guide 104 being disposed inside further than the sidewall 102, the end portion of the arm 220 enters the second recessed portion 106. At this time, the engaging portion 240 restricts pivoting of the arm 220. The end portion of the arm 220 is located above an upstream end of the third inclined surface 106D in the attachment direction or the front end of the third inclined surface 106D (refer to a horizontal plane W indicated by a broken line, which passes the upstream end of the third inclined surface 106D). In other words, the front end of the third inclined surface 106D is disposed below the end portion of the arm 220.

Operation and effects of the laser printer 1 according to the embodiment will be described.

The following will describe a case in which, when the side guide 104 is not in the second recessed portion 106, the sheet supply tray 31 is pulled out from the inside position to the outside position.

As illustrated in FIGS. 5A, 5B, and 6A, while the sheet supply tray 31 located in the inside position is pulled to the front, the arm 220 of the restriction member 200 slides on the third upper end surface 102C, enters the second recessed portion 106, and then gets on the third inclined surface 106D.

At this time, as the end portion of the arm 220 is located above the front end of the third inclined surface 106D, it does not collide against the rear side surface 106C. The end portion of the arm 220 contacts the third inclined surface 106D, pivots upward along the third inclined surface 106D, and gets on the second upper end surface 102B. Then, the end portion of the arm 220 slides on the second upper end surface 102B. As illustrated in FIGS. 3A and 5B, when the side guide 104 is located at the most outside position, the upper end surface 104A of the side guide 104 is substantially flush with the third upper end surface 102C and the second upper end surface 102B. Thus, the end portion of the arm 220 slides on the third upper end surface 102C, the upper end surface 104A of the side guide 104, and the second upper end surface 102B.

As illustrated in FIG. 3B, as the left sidewall 102 is not provided with the second recessed portion 106, the arm 220 slides, from the inside position, on the second upper end surface 102B disposed at the front of the recessed portion 105.

As illustrated in FIG. 6B, when the end portion of the arm 220 enters the recessed portion 105, the end surface 220A of the arm 220 contacts the first inclined surface 105A as illustrated in FIG. 4A, which restricts the movement of the sheet supply tray 31.

Figure 7A:
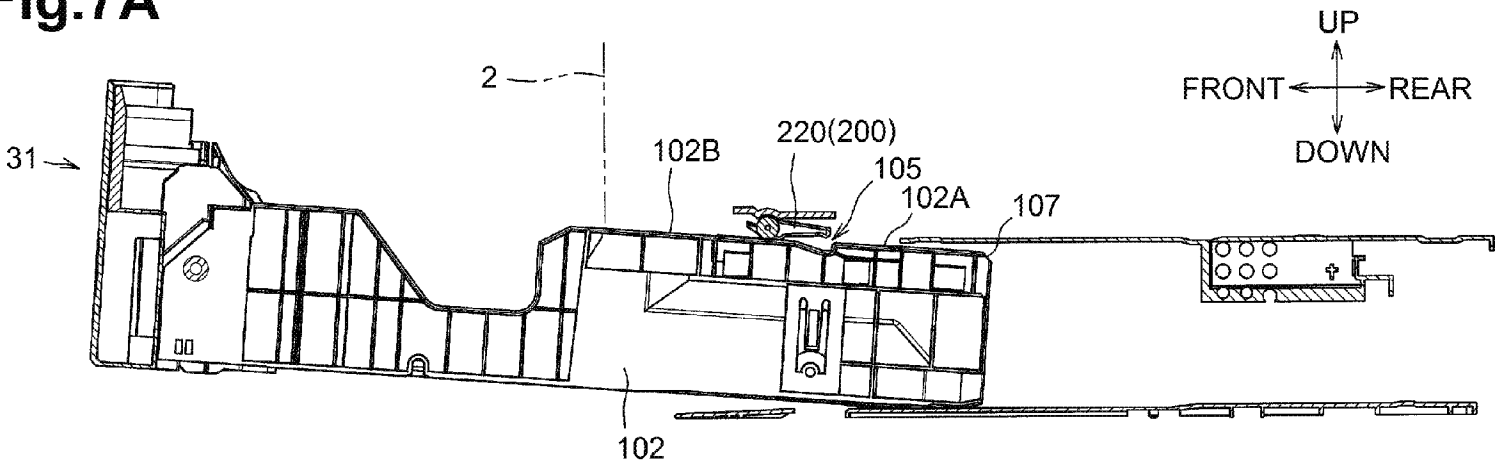
FIG. 7A illustrates the sheet supply tray pulled out from the outside position.
Figure 7B:
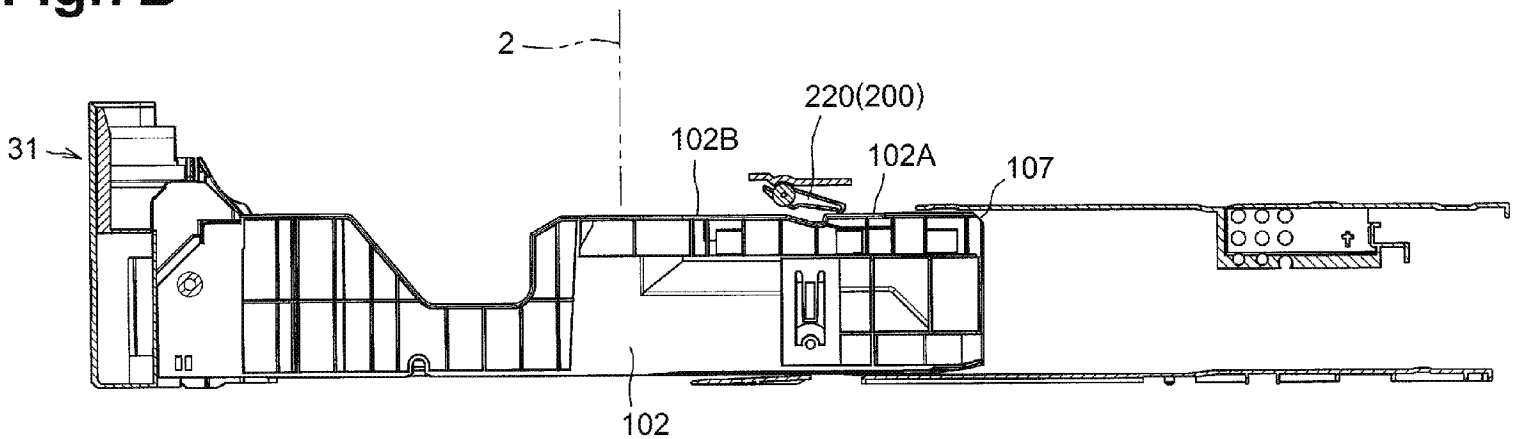
FIG. 7B illustrates the sheet supply tray further pulled out from the outside position.

As illustrated in FIG. 7A, when the sheet supply tray 31 is pivoted upward around the rear end portion thereof, the second upper end surface 102B raises the protruding portion 221 (FIG. 4B), and the arm 220 withdraws from the restriction position. As illustrated in FIG. 7B, when the sheet supply tray 31 is pulled out further to the front, in relative terms, the end portion of the arm 220 moves behind the recessed portion 105 and down to the first upper end surface 102A, and slides thereon. In this way, the sheet supply tray 31 is pulled out of the casing 2.

The following will describe that the sheet supply tray 31 is attached to the inside position outside of the casing 2.

The sheet supply tray 31 is kept horizontally and inserted into the casing 2. At this time, the arm 220, which is directed diagonally downward to the rear, is pressed upward by the rear end of the sidewall 102 from the front, the end portion of the arm 220 pivots upward, and gets on the first upper end surface 102A smoothly. In other words, the arm 220 is raised to the withdrawal position by the rear end of the first upper end surface 102A. As the rear end of the sidewall 102 includes the fourth inclined surface 107, the arm 220 smoothly pivots along the fourth inclined surface 107 and gets on the first upper end surface 102A. As illustrated in FIG. 6B, when reaching the recessed portion 105, the arm 220 enters the recessed portion 105 by its weight, slides along the bottom surface 105 and the second inclined surface 105C, and gets on the second upper end surface 102B.

As illustrated in FIGS. 5A and 5B, after sliding on the second upper end surface 102B, the arm 220 enters the second recessed portion 106, and is pressed upward by the front side surface 106A from the front, and gets on the third upper end surface 102C. The arm 220 slides on the third upper end surface 102C, and the sheet supply tray 31 is located in the inside position.

As illustrated in FIG. 3B, regarding the left sidewall 102, the arm 220 slides on the second upper end surface 102B, and the sheet supply tray 31 is located in the inside position.

In this manner, the sheet supply tray 31 can be smoothly attached to the inside position without itself being rotated. Thus, ease of use of the sheet supply tray 31 during attachment and removal can be improved.

The laser printer 1 described in the above embodiment provides following advantages.

When the sheet supply tray 31 is attached to the casing 2, the first upper end surface 102A causes the restriction member 200 to move to the withdrawal position before the sheet supply tray 31 reaches the outside position. This structure eliminates the need for an operation that the restriction member 200 moves over the first inclined surface 105A. In other words, the sheet supply tray 31 can be mounted in the casing 2 without restriction by the restriction member 200, which improves the ease of use in attachment and removal of the sheet supply tray 31 relative to the casing 2.

As the arm 220 is provided in the casing 2, the arm 220 is not exposed outside of the casing 2. Thus, the arm 220 resists damage in comparison with a case the arm is provided in the sheet supply tray.

As the first angle a is smaller than the second angle β, when the sheet supply tray 31 is in the outside position, a force applied from the first inclined surface 105A to the arm 220 would not act in a direction to raise the arm 220. Thus, when the sheet supply tray 31 is pulled out and the arm 220 contacts the first inclined surface 105A, the arm 220 can be prevented from coming off from the first inclined surface 105A. As the first inclined surface 105A is inclined downward to the front, when the sheet supply tray 31 is pivoted, the restriction by the arm 220 is easily released as compared with a case in which the first inclined surface 105A is inclined downward to the rear.

The arm 220 is provided with the protruding portion 221. When the restriction is released, the second upper end surface 102B presses the protruding portion 221, which causes the end portion of the arm 220 to pivot greatly. Thus, as compared with a case where the arm 220 has no protruding portion, the restriction can be released by slightly pivoting the sheet supply tray 31. As the pivoting range of the sheet supply tray 31 is small, the casing 2 can be provided in small size.

When the sheet supply tray 31 is in the outside position, the second upper end surface 102B is spaced from the protruding portion 221. This spacing can prevent the release of the restriction by the arm 220 due to vibration of the casing 2.

The first inclined surface 105A partially defines the recessed portion 105 formed in the sidewall 102. Thus, the sheet supply tray 310 can be made smaller as compared with a case where a first inclined surface is provided separately from a sidewall.

The recessed portion 105 includes the second inclined surface 105C upstream of the first inclined surface 105A in the attachment direction. When the sheet supply tray 31 is moved between inside position and the outside position, the end portion of the arm 220 moves along the second inclined surface 105C. Thus, the sheet supply tray 31 can be moved smoothly in compared with a case where an upstream portion of a recessed portion is stepped.

The end of the second protruding portion 222 to contact the sidewall 102 is tapered. This will reduce contact resistance between the arm 220 and the sidewall 102.

The engaging portion 240 to engage the protruding portion 230 of restriction member 200 can prevent the end portion of the arm 220 from excessively lowering. This structure can prevent the arm 220 from being inadvertently touched by a user. In addition, the sheet supply tray 31 can be smoothly attached to the casing 2.

The end portion of the arm 220 slides on the upper end surfaces 102A, 102B and 102C of a sidewall 102. Thus, the sheet supply tray 31 can be structured simpler and made smaller as compared with a case where the end portion of the arm 220 slides on a portion other than the sidewall.

A portion of the side guide 104 is located in the second recessed portion 106. Thus, the sidewall 102 can be disposed inside by an amount that the portion of the side guide 104 is located in the second recessed portion 106 as compared with a case where the sidewall is not provided with the second recessed portion. Thus, the sheet supply tray 31 can be made small.

The third inclined surface 106D is disposed downstream of the second recessed portion 106 in the attachment direction. When the sheet supply tray 31 is pulled out, the third inclines surface 106D facilitates smooth movement of the end portion of the arm 220 from the second recessed portion 106 toward the second upper end surface 102B of the sidewall 102, and thus prevents the arm 220 from being caught by a wall of the second recessed portion 106.

Figure 8:
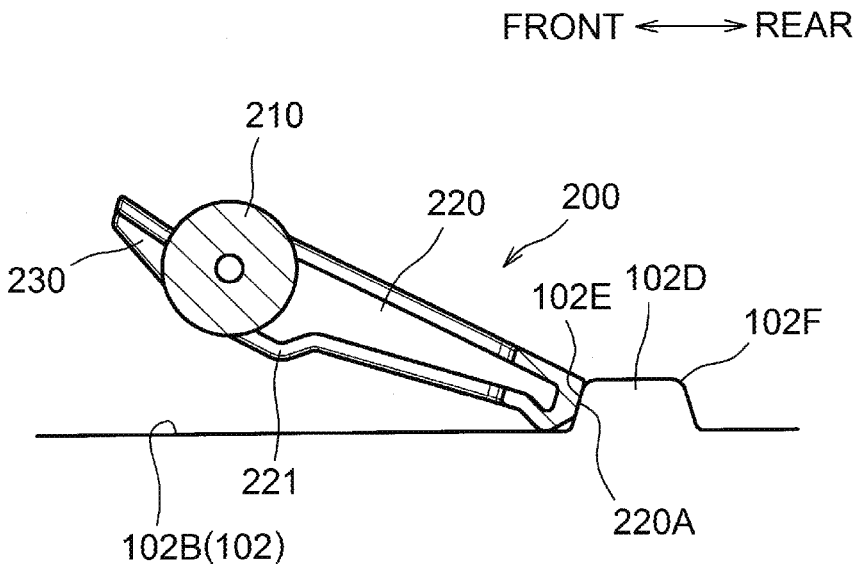
FIG. 8 illustrates a restriction member according to a first modification of the disclosure, corresponding to FIG. 4A.

The above embodiment shows, but is not limited to, the first inclined surface 105A constituting a part of the surfaces defining the recessed portion 105. For example, in a first modification as illustrated in FIG. 8, the sidewall 102 may include a protruding portion 102D protruding upward from the sidewall 102, and an upstream surface (or a front-side surface) of the protruding portion 102D in the attachment direction may be regarded as a first inclined surface 102E.

The first inclined surface 102E of the first modification is disposed at the same position as the first inclined surface 105A of the above embodiment. The first inclined surface 102E is inclined downward to the front. Even with this structure, the sheet supply tray 31 can be restricted from moving outside of the casing 2 by engagement of the first inclined surface 102E with the end surface 220A of the arm 220.

When the sheet supply tray 31 is attached to the casing 2, the protruding portion 102D contacts the arm 220 from the front side, the end portion of the arm 220 pivots upward and moves onto the protruding portion 102D. Specifically, an inclined surface 102F of the protruding portion 102D functions as a contact surface causing the restriction member 200 to move upward to the withdrawal position. Then, the arm 220 moves down to the second inclined surface 102B by its weight, and slides on the second inclined surface 102B smoothly to the inside position.

Figure 9A:
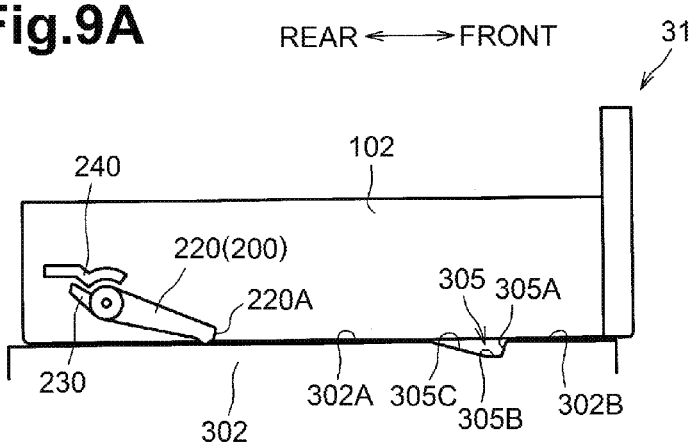
FIG. 9A illustrates a sheet supply tray located in an inside position according to a second modification of the disclosure.
Figure 9B:
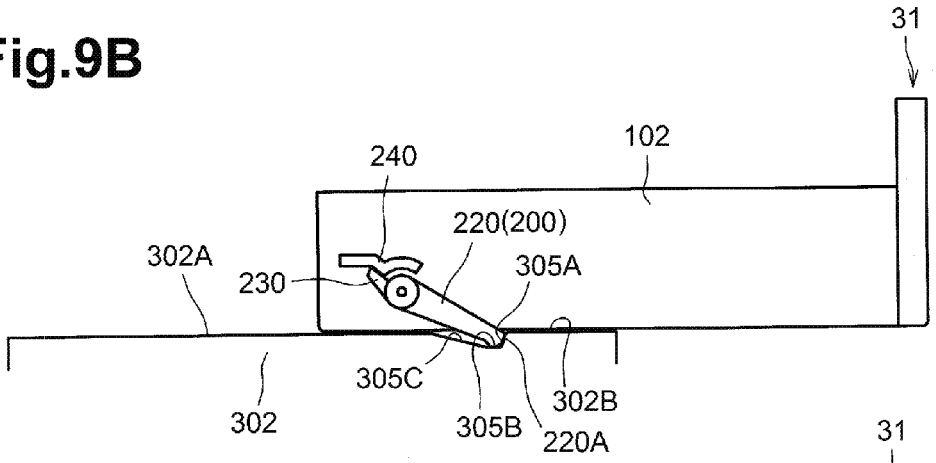
FIG. 9B illustrates the sheet supply tray located in an outside position according to the second modification.
Figure 9C:
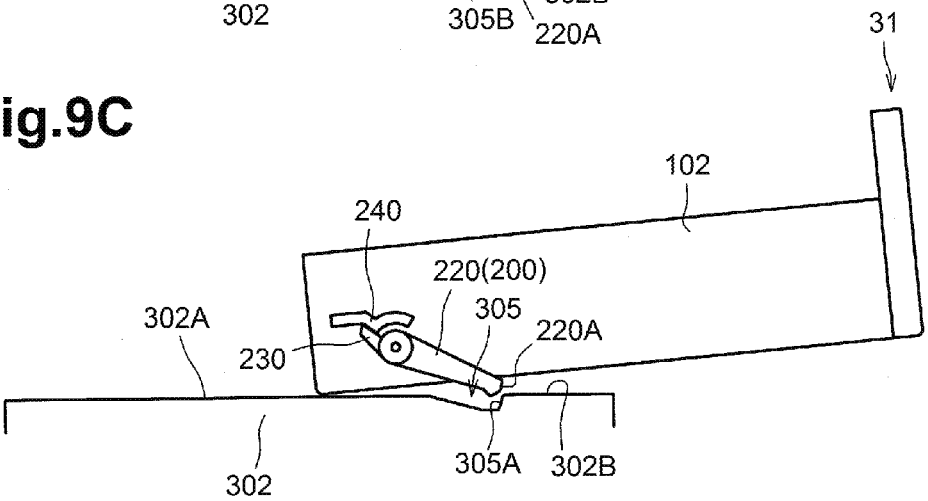
FIG. 9C illustrates the sheet supply tray pulled out from the outside position according to the second modification.

The above embodiment shows, but is not limited to, the restriction member 200 disposed in the casing 2. For example, in a second modification as illustrated in FIGS. 9A, 9B, and 9C, the restriction member 200 may be disposed on the side wall 102.

The restriction member 200 of the second modification is identical in structure to that of the above embodiment except for that the restriction member 200 of the second modification lacks the protruding portion 221 of the above embodiment. The restriction member 200 of the second modification is disposed on a lower rear portion of the side wall 102 of the sheet supply tray 31. The sheet supply tray 31 is configured to slide on a guide portion 302 of which bottom surface is attached to the casing 2 and extending in the front-rear direction. The sheet supply tray 31 is provided with an engaging portion 240, which is identical in shape to that of the above embodiment and disposed in a position corresponding to the restriction member 200.

The guide portion 302 extends in the front-rear direction, and is provided with a recessed portion 305 which is recessed downward from a front guide surface of the guide portion 302. The recessed portion 305 is shaped by a first inclined surface 305A, a bottom surface 305B, and a second inclined surface 305C, as is the case with the recessed portion 105 of the above embodiment.

With this structure, when the sheet supply tray 31 is pulled out, the arm 220 moves along a first guide surface 302A of the guide portion 302, which is disposed at the rear of the recessed portion 305, into the recessed portion 305 and an end surface 220A contacts the first inclined surface 305A. Thus, the movement of the sheet supply tray 31 outside of the casing 2 can be restricted.

When the sheet supply tray 31 is pivoted about its rear end portion, the engaging portion 240 engages the protruding portion 230, the end surface 220A of the arm 220 is lifted out of engagement with the first inclined surface 305A. At this time, a lower surface of the engaging portion 240, which contacts the protruding portion 230, functions as a restriction release surface. When the sheet supply tray 31 is attached to the casing 2, the restriction member 200 is moved upward to the withdrawal position by a front end of a second guide surface 302B of the guide portion 302, which is disposed in front of the recessed portion 305. In other words, the second guide surface 302B functions as a contact surface causing the restriction member 200 to move to the withdrawal position. Then, the arm 220 enters the recessed portion 305 by its weight, slides on the bottom surface 305B and the second inclined surface 305C, smoothly moves onto the first guide surface 302A, and slides on the first guide surface 302A to the inside position.

The above embodiment shows, but is not limited to, that the second arm 220 includes the second protruding portion 222. The second arm portion 222 may be omitted.

The above embodiment shows, but is not limited to, that the end portion of the arm 220 is configured to slide on the upper end surface of the sidewall 102 of the sheet supply tray 31. The end portion of the arm 220 may slide on a portion other than the sidewall.

The above embodiment shows, but is not limited to, that the sidewall 102 is provided with the second recessed portion 106. The second recessed portion 106 may be omitted.

The above embodiment shows, but is not limited to, that the sheet supply tray 31 includes the tray extension portion 110. The tray extension portion 110 may be omitted.

The above embodiment shows, but is not limited to, the laser printer 1 as an example of an image forming apparatus. The disclosure may be applied to other types of image forming apparatuses, e.g., a copier, and a multifunction apparatus.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a main body;

a sheet supply tray configured to slide along a specified direction relative to the main body and move between an inside position where the sheet supply tray is attached to the main body and an outside position in which the sheet supply tray is pulled out from the inside position; and a restriction member configured to, when the sheet supply tray is in the outside position, which is upstream of the inside position in an attachment direction in which the sheet supply tray is attached to the main body, restrict movement of the sheet supply tray to outside of the main body, the restriction member including an arm configured to move between a restriction position where the arm restricts movement of the sheet supply tray and a withdrawal position where the arm is withdrawn from the restriction position, the arm being configured to pivot about an axis relative to the main body and extending from the axis, wherein one of the main body and the sheet supply tray includes the restriction member, wherein the other one of the main body and the sheet supply tray includes:

a first inclined surface configured to restrict the movement of the sheet supply tray to the outside of the main body by contact with the restriction member located at the restriction position; and a contact surface configured to, when the sheet supply tray moves toward the inside position, cause the restriction member to move to the withdrawal position by contact with the restriction member before the sheet supply tray reaches the outside position, and wherein the image forming apparatus further comprises a restriction release surface configured to, when the sheet supply tray moves from the inside position toward outside of the main body, contact the restriction member to cause the restriction member to move from the restriction position to the withdrawal position by which the sheet supply tray located at the outside position pivots around a downstream end of the sheet supply tray in the attachment direction.

2. The image forming apparatus according to claim 1, wherein the sheet supply tray includes the restriction release surface.

3. The image forming apparatus according to claim 2, wherein the main body includes the restriction member, and wherein the sheet supply tray includes the first inclined surface and the contact surface.

4. The image forming apparatus according to claim 1, wherein the sheet supply tray includes the restriction release surface.

5. The image forming apparatus according to claim 4, wherein the main body includes the first inclined surface and the contact surface, and wherein the sheet supply tray includes the restriction member.

6. The image forming apparatus according to claim 1, wherein the main body includes the restriction member, wherein the sheet supply tray includes the first inclined surface, the contact surface, and the restriction release surface, and wherein the arm of the restriction member extends downward from the axis to a downstream side in the attachment direction.

7. The image forming apparatus according to claim 6, wherein the first inclined surface of the sheet supply tray is inclined downward to an upstream side in the attachment direction, and wherein a first angle of the first inclined surface with respect to a first plane orthogonal to the attachment direction is smaller than a second angle formed by a line parallel to the attachment direction and a line connecting the axis and a contact point where an end of the arm contacts the first inclined surface.

8. The image forming apparatus according to claim 7, wherein the arm of the restriction member includes a protruding portion disposed closer to the axis than the end of the arm and protruding downward, and wherein the restriction release surface is disposed upstream of the first inclined surface in the attachment direction.

9. The image forming apparatus according to claim 8, wherein, when the sheet supply tray is located at the outside position, the restriction release surface is spaced apart from the protruding portion of the arm.

10. The image forming apparatus according to claim 6, wherein the sheet supply tray includes a bottom wall and a sidewall extending upward from the bottom wall, wherein the sidewall of the sheet supply tray extends in the specified direction, and has a recessed portion recessed downward, and wherein the first inclined surface constitutes a part of a surface defining the recessed portion.

11. The image forming apparatus according to claim 10, wherein the surface defining the recessed portion includes a second inclined surface disposed upstream of the first inclined surface in the attachment direction and inclined upward from a downstream side toward an upstream side in the attachment direction.

12. The image forming apparatus according to claim 6, wherein the sheet supply tray includes a bottom wall and a sidewall extending upward from the bottom wall and extending in the specified direction, wherein the arm has an end portion and the end portion of the arm has a second protruding portion having a downward end which is tapered, and wherein the downward end of the second protruding portion of the arm is configured to contact the sidewall of the sheet supply tray being attached to and removed from the main body.

13. The image forming apparatus according to claim 6, wherein the main body includes a restricting portion configured to, when the sheet supply tray is removed from the main body, engage the restriction member and restrict the arm of the restriction member from pivoting downward.

14. The image forming apparatus according to claim 6, wherein the sheet supply tray includes a bottom wall and a sidewall extending upward from the bottom wall and extending in the specified direction, and wherein the arm includes an end portion configured to slide on an upper end surface of the sidewall.

15. The image forming apparatus according to claim 14, wherein the sidewall has a second recessed portion recessed downward and disposed upstream of the first inclined surface in the attachment direction, wherein the sheet supply tray includes a side guide disposed at a position corresponding to the second recessed portion and configured to move in directions close to and remote from the sidewall, and wherein, when the side guide is closest to the sidewall, a part of the side guide is located in the second recessed portion, and an upper end surface of the part of the side guide is configured to contact the end portion of the arm.

16. The image forming apparatus according to claim 15, wherein a surface defining the second recessed portion includes a downstream portion in the attachment direction, the downstream portion including a third inclined surface inclined upward to a downstream side in the attachment direction.

17. The image forming apparatus according to claim 16, wherein an upstream end of the third inclined surface in the attachment direction is below the end portion of the arm.

18. The image forming apparatus according to claim 1, wherein the sheet supply tray includes a bottom wall, first and second sidewalls extending upward from the bottom wall and facing each other, a front wall connecting the first and second sidewalls, and a dust storing portion configured to store sheet dust therein, wherein the front wall is disposed at an upstream end of the sheet supply tray in the attachment direction, wherein the dust storing portion is disposed downstream of the front wall in the attachment direction, and wherein the dust storing portion includes a wall extending toward an upper end of the front wall and disposed along the front wall.

* * * * *